US009234422B2

(12) United States Patent
Hall

(10) Patent No.: US 9,234,422 B2
(45) **Date of Patent: *Jan. 12, 2016**

(54) SENSORED PICK ASSEMBLY

(71) Applicant: Schlumberger Technology Corporation, Sugar land, TX (US)

(72) Inventor: David R. Hall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/339,452

(22) Filed: Jul. 24, 2014

(65) Prior Publication Data

US 2014/0327295 A1 Nov. 6, 2014

Related U.S. Application Data

(63) Continuation of application No. 13/448,635, filed on Apr. 17, 2012, now Pat. No. 8,820,845.

(51) Int. Cl.
*E21C 39/00* (2006.01)
*E21C 35/18* (2006.01)
*E21C 35/183* (2006.01)

(52) U.S. Cl.
CPC ..... *E21C 35/18* (2013.01); *E21C 35/183* (2013.01); *E21C 39/00* (2013.01); *E21C 2035/1813* (2013.01)

(58) Field of Classification Search
CPC ..... E21C 39/00
USPC ..... 299/1.05, 1.1, 1.2, 1.4, 1.5, 1.6
See application file for complete search history.

(56) References Cited

U.S. PATENT DOCUMENTS

| | | | | |
|---|---|---|---|---|
| 3,102,718 | A * | 9/1963 | Eberle | 299/1.2 |
| 3,333,893 | A * | 8/1967 | Heimaster | 299/1.2 |
| 3,550,959 | A * | 12/1970 | Alford | 299/1.2 |
| 3,591,235 | A * | 7/1971 | Addison | 299/1.2 |
| 4,001,798 | A * | 1/1977 | Robinson | 340/870.18 |
| 4,181,360 | A * | 1/1980 | Wilson | 299/1.2 |
| 5,092,657 | A * | 3/1992 | Bryan, Jr. | 299/1.1 |
| 8,820,845 | B2 * | 9/2014 | Hall | 299/1.05 |
| 2013/0270890 | A1 | 10/2013 | Hall | |

FOREIGN PATENT DOCUMENTS

GB 2036127 A * 6/1980

* cited by examiner

*Primary Examiner* — Sunil Singh
(74) *Attorney, Agent, or Firm* — Chadwick A. Sullivan; Wesley Noah

(57) ABSTRACT

A degradation assembly may comprise at least one sensor mounted on a pick; the pick comprising a first conductor in communication with the sensor. The assembly may also comprise a receiving element including a bore comprising a second conductor. The first and second conductors may combine to create a connection as the pick is inserted into the bore of the receiving element.

15 Claims, 7 Drawing Sheets

SENSORED PICK ASSEMBLY

This application is a continuation of U.S. patent application Ser. No. 13/448,635, filed on Apr. 17, 2012, which is incorporated herein by reference in the entirety.

BACKGROUND OF THE INVENTION

Degradation assemblies may be used in mining, trenching, and road milling operations to degrade natural and man-made formations. The present invention relates to degradation assemblies and especially to degradation assemblies comprising sensors. The following references disclose degradation assemblies comprising sensors that measure various occurrences during a degradation process.

U.S. Pat. No. 2,741,468 to Alspaugh, discloses a thermocouple mounted in an outer tooth of a boring machine. The thermocouple is electrically connected to a remote control point and thereby conveys temperature readings to a meter at that point. Electrical connections from the thermocouple are carried through an arm assembly to slip rings by means of cable.

U.S. Pat. No. 4,181,360 to Wilson, discloses a mineral mining machine comprising a rotary cutter head with a sensor to detect a cutting horizon of the cutter head relative to a boundary of a mineral seam and to derive a signal indicative of changes in the cutting horizon.

It is known to mount sensor means on a cutter tool, on a cutter tool holder, and directly on a cutter head itself. However, as sensors are disposed closer to the point of degradation, it may become necessary to quickly replace a sensor at the same time worn cutters are replaced. It is an object of the present invention to provide a means for such quick replacement.

BRIEF SUMMARY OF THE INVENTION

In one aspect of the present invention a degradation assembly may comprise at least one sensor mounted on a pick; the pick may further comprise a first conductor in communication with the sensor. The degradation assembly may also comprise a receiving element which may include a bore comprising a second conductor. The first and second conductors may form a connection as the pick is inserted into the bore of the receiving element.

The connection may form from a stab connector that is disposed between the pick and the receiving element. The connection may alternately be created through an inductive coupling between the first and second conductors. Insulation material may surround the first and second conductors. In other embodiments, the connection may form from flat contact surfaces as well as other forms of direct contact between the surfaces of the first and second conductors. The connection may be releasable.

The receiving element may be mounted onto a driving mechanism that may comprise a rotary degradation drum. The receiving element may be configured to support the pick at an angle of attack. The bore of the receiving element may comprise an inside surface that is complementary to an outside surface of the pick shank, the complementary surfaces may be tapered. The receiving element may be selected from the group consisting of blocks, sleeves, holders and spring clips.

The sensors may be selected from the group consisting of strain gauges, accelerometers, thermocouples, or magnetometers. Some sensors may be powered by an external power source. At least one sensor may be disposed within a shank of the pick. The shank of the pick may comprise an annular recess and a clamp ring may be disposed around the annular recess within the shank. The pick may comprise a frustoconical bolster adjacent to the tip of the pick. The pick may comprise a conical degradation tip which may further comprise a polycrystalline diamond material.

DETAILED DESCRIPTION OF THE INVENTION AND THE PREFERRED EMBODIMENT

Figure 1:
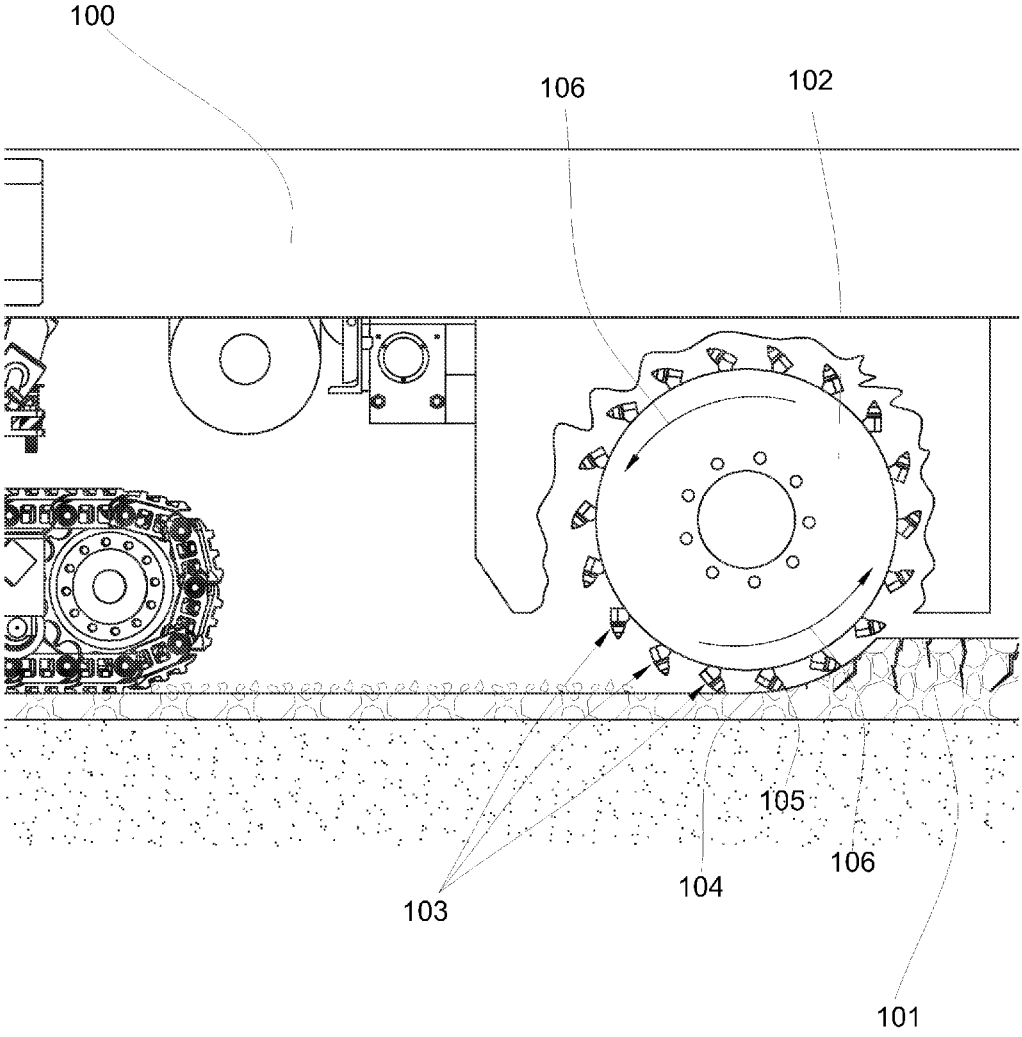
FIG. 1 discloses an orthogonal view of an embodiment of a rotary degradation machine.

Referring now to the figures, FIG. 1 discloses an embodiment of a rotary degradation machine in the form of a road milling machine 100. The road milling machine 100 also known as a cold planer, may be used to degrade a formation 101 such as pavement, concrete, or asphalt prior to placement of a new layer. Other types of rotary degradation machines may include mining, trenching or drilling machines that may degrade both natural and manmade formations. The road milling machine 100 may comprise a driving mechanism such as a rotary degradation drum 102. The rotary degradation drum 102 may comprise a plurality of pick assemblies 103 secured to its outer surface. Each of the pick assemblies 103 may comprise a receiving element 104 including a bore with a pick 105 secured within the bore of the receiving element 104. During normal operation, the degradation drum 102 may rotate in a direction indicated by arrows 106, causing the pick 105 to engage and degrade the formation 101. In other embodiments of the present invention, receiving elements may be secured to surfaces of drums, chains, or other moving parts of mining, trenching or road milling machines to cause picks to engage and degrade formations of all types. The receiving elements may include blocks, sleeves, holders or spring clips.

Figure 2:
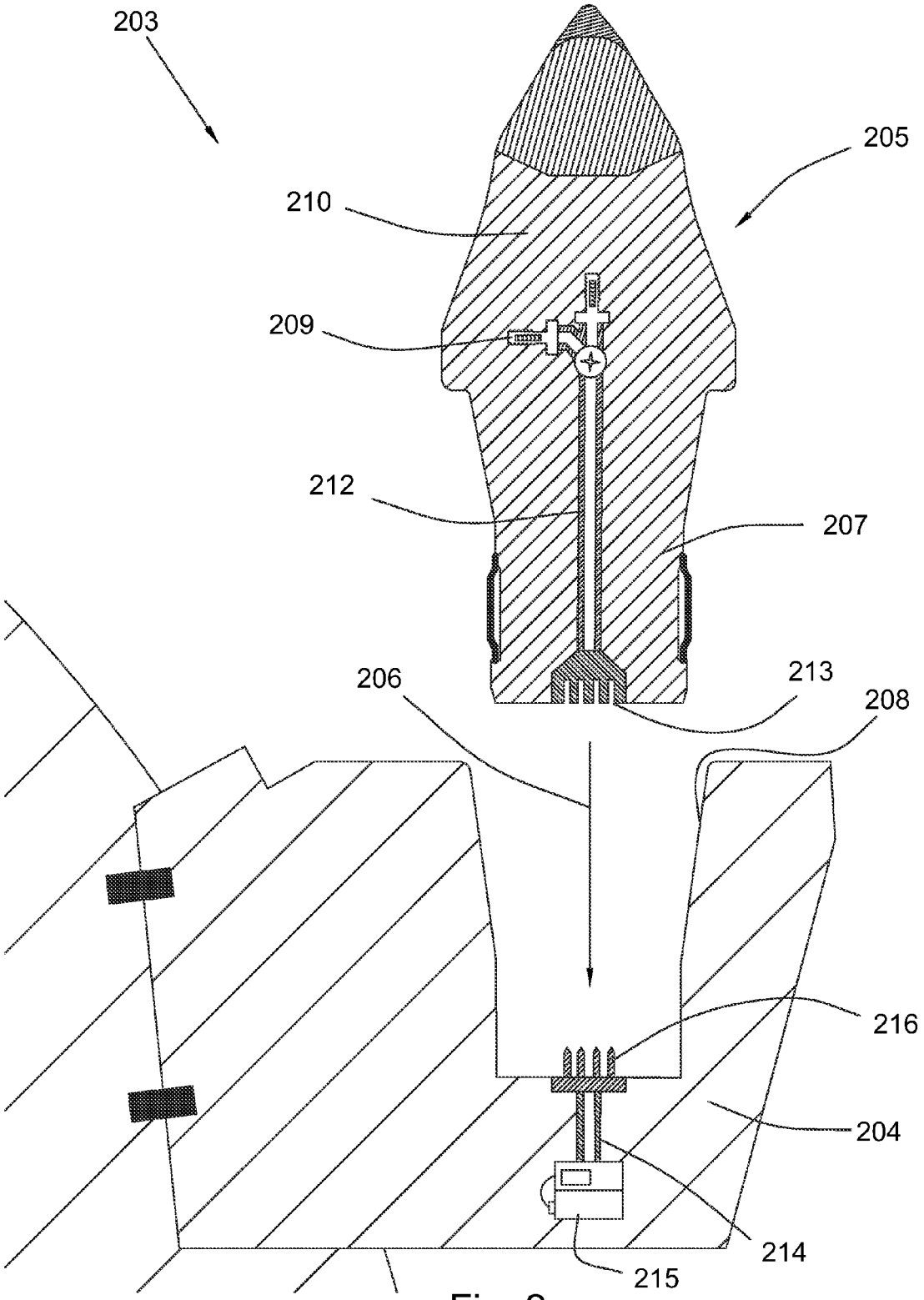
FIG. 2 discloses a cross-sectional view of an embodiment of a degradation assembly.

FIG. 2 discloses an embodiment of a degradation assembly 203. In the embodiment shown, a pick 205 is shown comprising a pick shank 207 entering into a bore 208 of a receiving element 204. As the pick 205 enters into the bore 208, the pick shank 207 may follow a path indicated by arrow 206. The pick 205 may comprise at least one sensor 209. In the current embodiment, the sensor 209 is disposed in a body 210 of the pick 205.

The sensor 209 may be selected from a group consisting of strain gauges, accelerometers, thermocouples, and magnetometers. The sensor 209 may be utilized to measure dynamic conditions that occur during the degradation process. The dynamic conditions may include a force, pressure, stress, or strain exerted on the pick 205 during degradation.

The sensor 209 may be in communication with a first conductor 212 that may distribute information that is gathered from the sensor 209 to at least one slot 213 disposed in a bottom portion of the pick shank 207. A second conductor 214 may be disposed within the receiving element 204 and may be in communication with a data logging device such as a transceiver 215. The second conductor 214 may extend from the transceiver 215 towards the pick shank 207 and end where at least one protrusion 216 is disposed along an inside surface of the bore 208. The conductors 212, 214 may comprise conductive materials that may include copper, aluminum, brass, or steel. The conductors 212, 214 may also comprise a fiber optic conductor, laser conductor, metal connection, inductive connections, acoustic connection, electromagnetic connection, or infrared signal connection.

Figure 3:
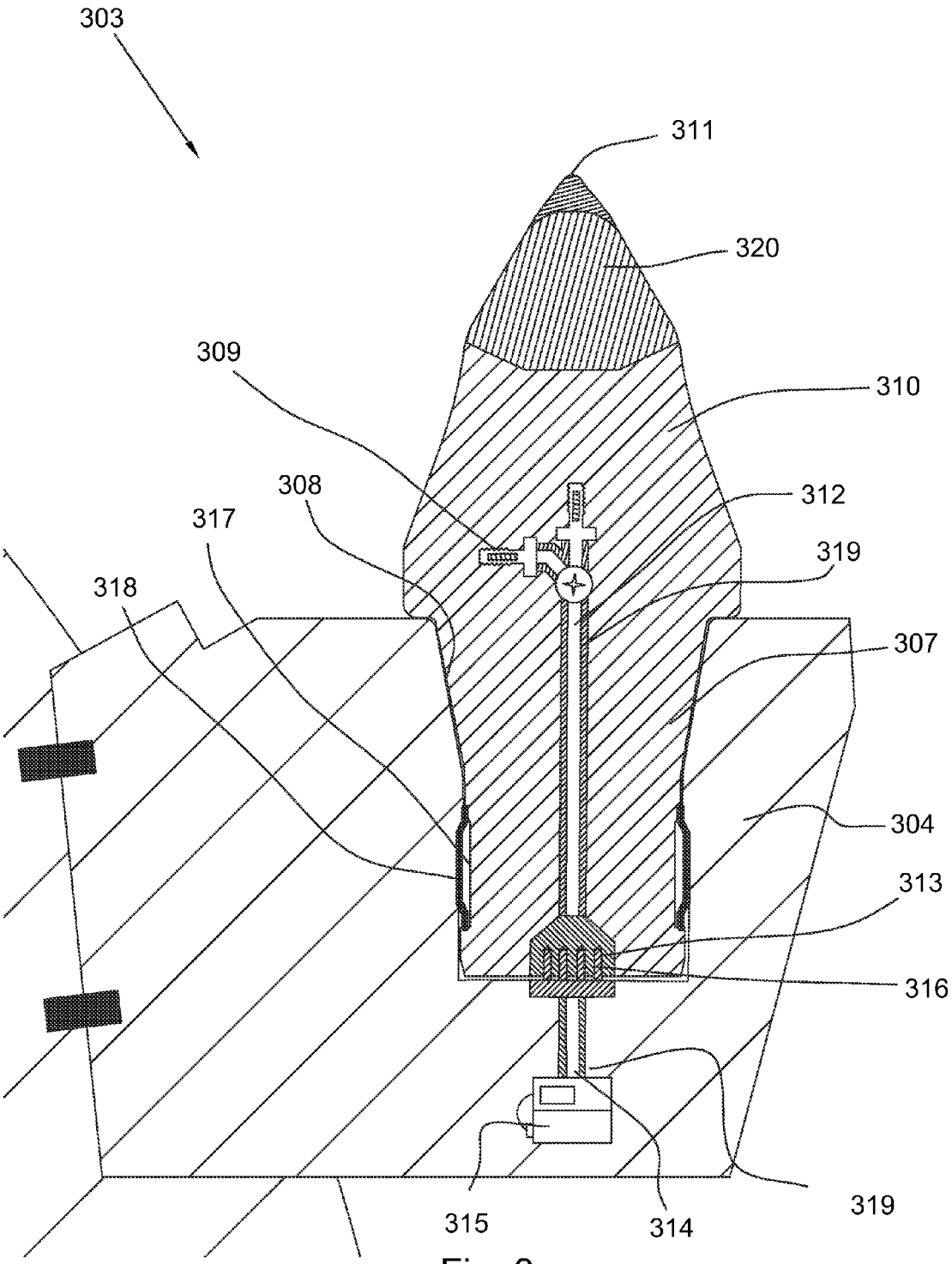
FIG. 3 discloses a cross-sectional view of another embodiment of a degradation assembly.

FIG. 3 discloses an embodiment of a degradation assembly 303 after a pick shank 307 has been received into a bore 308 of a receiving element 304. At least one protrusion 316 may mate with an individual slot 313 disposed in the pick shank 307 such that each protrusion may enter a single slot. This process may form a stab connection between a first conductor 312 in the pick shank 307 and a second conductor 314 in the receiving element 304. The stab connection formed by protrusion 316 and slot 313 may allow data to be transferred from the first conductor 312 that is attached to at least one sensor 309 and the second conductor 314 that is attached to a transceiver 315. Protrusion 316 and slot 313 may allow transfer of a single, uncompromised data set that is gathered from sensor 309. A separate protrusion and slot may be required for each data set gathered by each sensor. Protrusions and slots may be added or removed from the assembly 303 as needed for a desired measurement process.

The pick shank 307 may also comprise an outside surface. The bore 308 of the receiving element 304 may comprise an inside surface that is complementary to the outside surface of the pick shank 307. In the current embodiment, the inside surface of the bore 308 and the outside surface of the shank 307 are tapered. The tapered surfaces may further secure the pick shank 307 within the bore 308. The pick shank 307 may also comprise an annular recess 317, preferably around a base of the pick shank 307. A clamp ring 318 may be disposed within the annular recess 317. The clamp ring 318 may compress as the pick shank 307 is inserted into the bore 308. The compression may help retain the pick shank 307 within the bore 308 of the receiving element 304. The design of the clamp ring 318 combined with a sufficient angle of force may enable an easier release of the pick shank 307 from the bore 308 when the pick requires maintenance or replacement.

Protrusion 316 may be removed from its complementary slot 313 to enable removal of the pick shank 307 from the bore 308. The removal of the pick shank 307 may enable manual extraction of information stored in the transceiver 315. In other embodiments, the transceiver 315 may wirelessly transmit or send the information to a central processing unit (not shown). The information may transmit wirelessly through a signal, such as an electromagnetic or acoustic signal.

An insulation material 319 may surround outer portions of the first conductor 312 and second conductor 314. The insulation material 319 may preserve the data that is being transferred from the sensor 309.

The current embodiment of the pick may further comprise a conical degradation tip 311. The conical degradation tip 311 may be the first component of the pick that comes into contact with a formation. As a result, the conical degradation tip 311 may comprise a hardened material to prevent premature wear. The hardened material for the conical degradation tip 311 may comprise a polycrystalline diamond material.

Additionally, the conical degradation tip 311 may comprise a vertical axis through its apex. The apex may comprise a radius of curvature of at least 0.025 inches that is measured vertically along the axis. This apex may form a crushed barrier ahead of the conical degradation tip 311 during degradation. The crushed barrier may create a shield around the conical degradation tip 311. This shielding may increase the pick assembly's 303 life.

The conical degradation tip 311 may be disposed adjacent a frustoconical bolster 320. The frustoconical bolster 320 may comprise a material that is harder than a body 310 of the pick but softer than the conical degradation tip 311. The frustoconical bolster 320 may come into more contact with the degrading formation than the body 310. As a result, the frustoconical bolster 320 may need to comprise a material that is harder than the body 310 to withstand the greater wear. However, the frustoconical bolster 320 may come into less contact with the formation than the conical degradation tip 311. As a result, a softer material than the polycrystalline diamond material may be used to provide sufficient support and life.

Figure 4C:
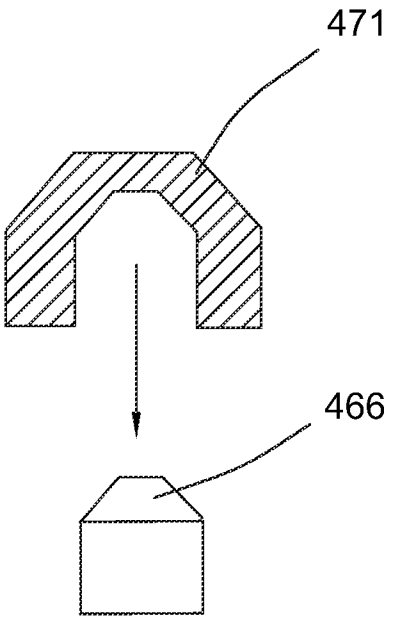
FIGS. 4*a*, 4*b* and 4*c* disclose orthogonal views of embodiments of stab connections.
Figure 4B:
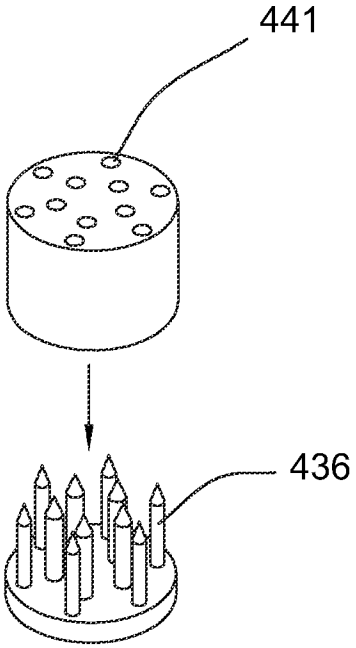
Figure 4A:
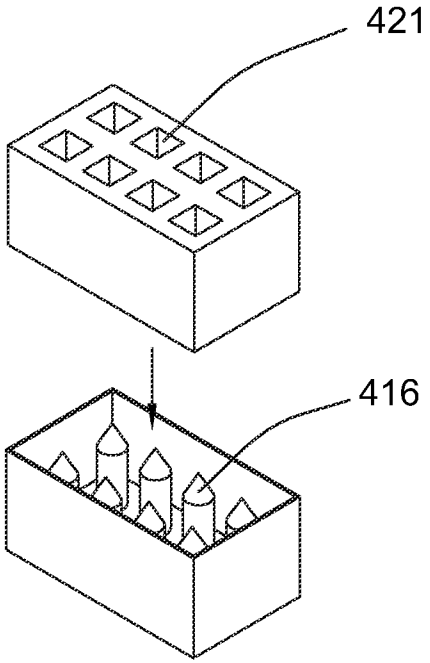

FIGS. 4*a*-4*c* disclose various embodiments of stab connections that may be disposed in pick assemblies. FIG. 4*a* discloses protrusions 416 and receptacles 421 arranged in a rectangular formation that may allow the protrusions 416 to enter into the receptacles 421 and form a connection. FIG. 4*b* discloses protrusions 436 and complementary receptacles 441 that are disposed in a circular pattern. FIG. 4*c* discloses a single protrusion 466 that is substantially frustoconical and a single receptacle 471. This embodiment may be used when it is desired to transmit information resulting from a single set of data. Protrusions and receptacles may also be disposed in other geometric configurations.

Figure 5:
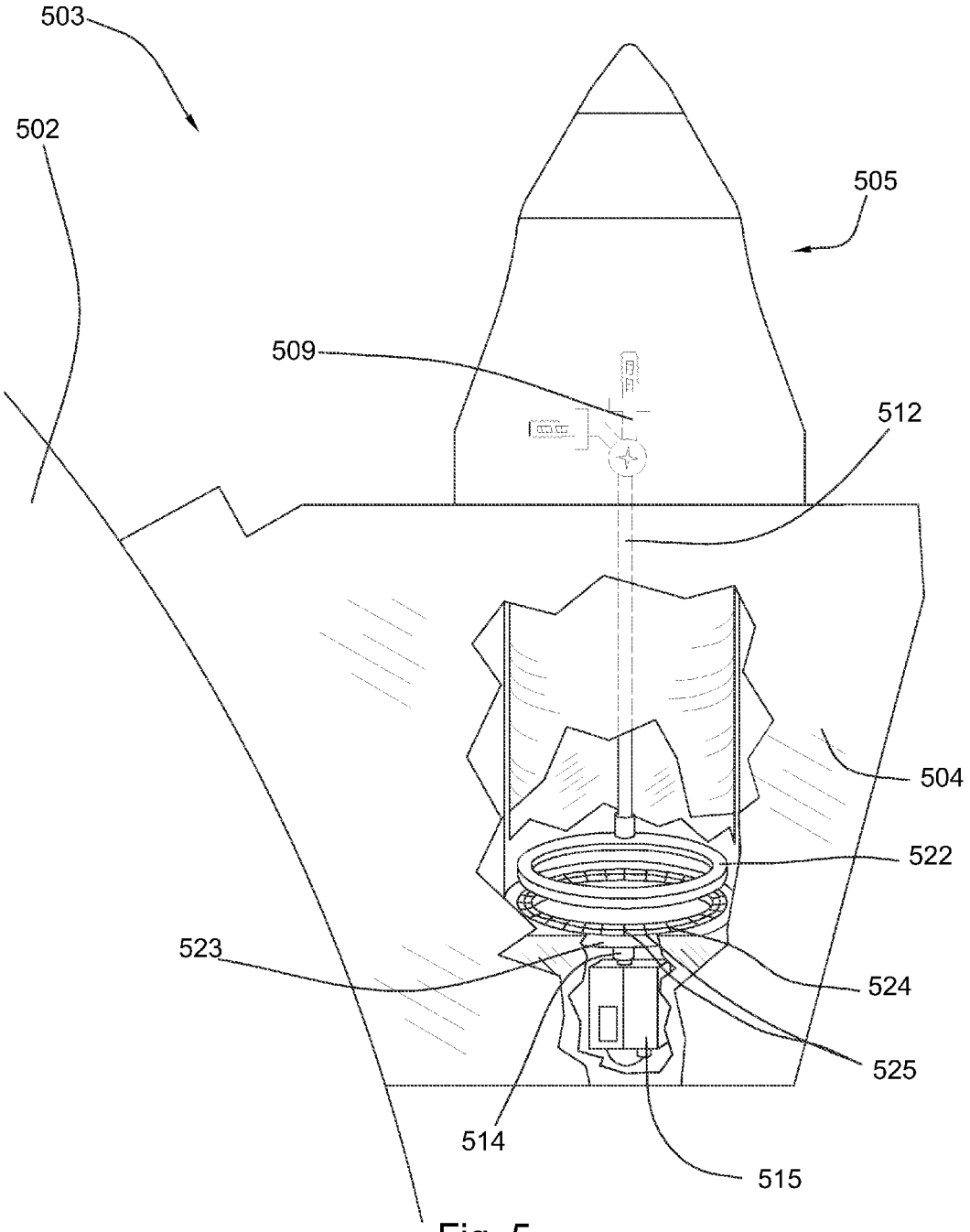
FIG. 5 discloses a cutaway view of an embodiment of a degradation assembly.

FIG. 5 discloses an embodiment of a degradation assembly 503. In this embodiment, a pick 505 is disposed in a receiving element 504 that is attached to a rotary degradation drum 502. The pick 505 may comprise at least one sensor 509 connected to a first conductor 512. The first conductor 512 may extend along a length of the pick 505 and attach to a first conductor ring 522. A data logging device 515 such as a transceiver may be disposed within the receiving element 504 and connect to a second conductor ring 523 through a second conductor 514. A connection between the first and second conductor rings 522, 523 may occur through inductive coupling. The first and second conductor rings 522, 523 may be designed such that a change in current flow through the first conductor ring 522 may induce a voltage through the second conductor ring 523 through the process of electromagnetic induction. In the current embodiment, the second conductor ring 523 is shown mirroring a position of the first conductor ring 522. The second conductor ring 523 may have a wire 524 running through it. The wire 524 may run through various sections 525 of the second conductor ring 523. The first conductor ring 522 may also have a wire running through various sections. The data received by the second conductor ring 523 from the first conductor ring 522 may be transferred through the second conductor 514 to be stored in the data logging device 515.

Figure 6:
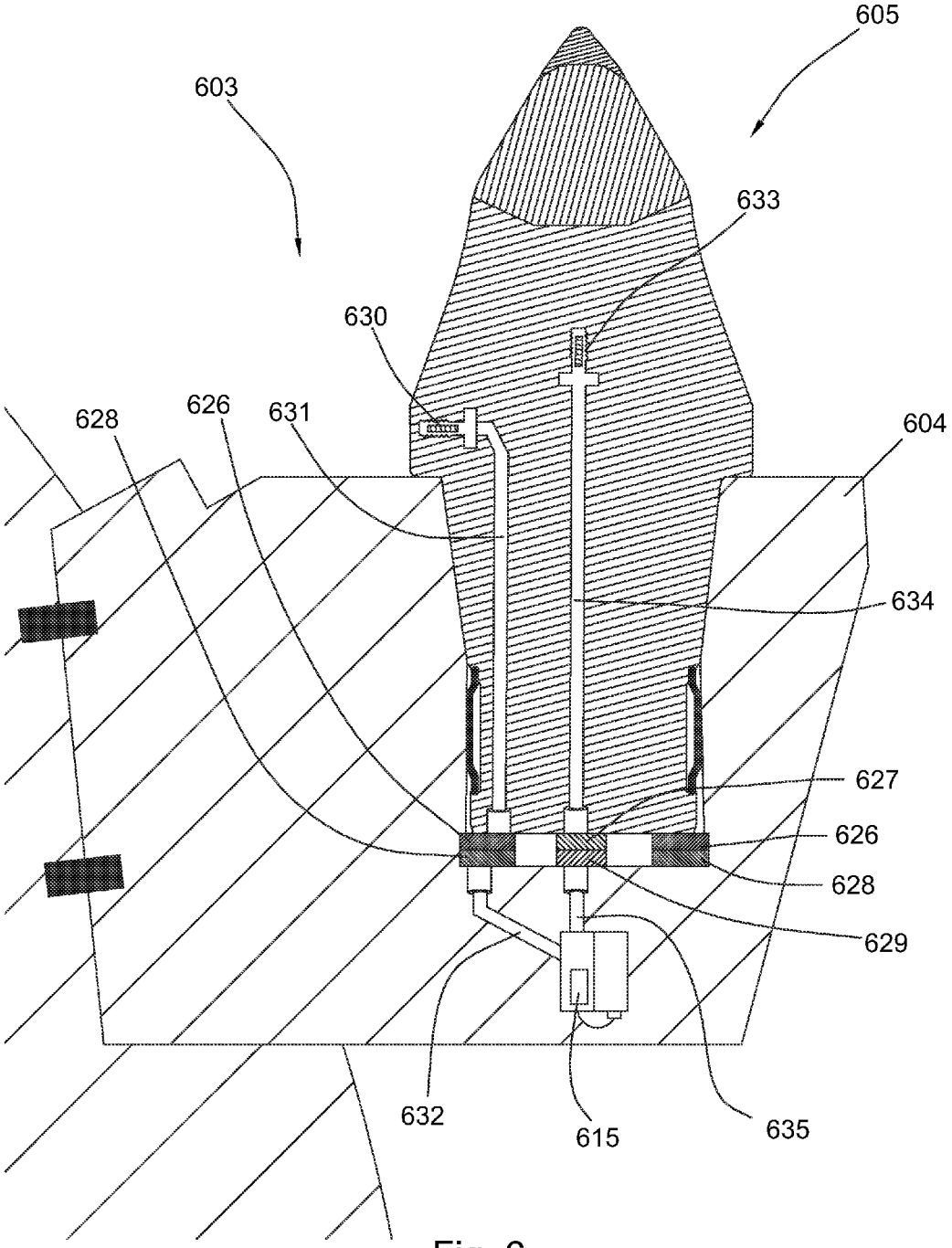
FIG. 6 discloses a cross-sectional view of another embodiment of a degradation assembly.

FIG. 6 discloses an embodiment of a degradation assembly 603. The degradation assembly 603 may comprise a first outer conductor 626 and a first inner conductor 627 disposed on a pick 605. The first outer and first inner conductors 626, 627 may each comprise a substantially circular geometry. A second outer conductor 628 and a second inner conductor 629 may be disposed within a receiving element 604. The second outer conductor 628 may be disposed substantially adjacent to the first outer conductor 626 while the second inner conductor 629 may be disposed substantially adjacent to the first inner conductor 627. Additionally, the first and second outer conductors 626, 628 may be substantially concentric with the first and second inner conductors 627, 629.

An outer sensor 630 may be in communication with the first outer conductor 626 through a first outer conduction wire 631. Information may transfer through the first outer conductor 626 to the second outer conductor 628. The second outer conductor 628 may connect to a second outer conduction wire 632 that is in communication with a transceiver 615 or other data logging device. Additionally, an inner sensor 633 may be in communication with the first inner conductor 627 through a first inner conduction wire 634. Information may transfer through the first inner conductor 627 to the second inner conductor 629. The second inner conductor 629 may connect to a second inner conduction wire 635 that is in communication with the transceiver 615 or other data logging device. The information transferred to the transceiver 615 may then be removed manually or transmitted wirelessly to a central processing unit (not shown).

In other embodiments, additional sensors and first and second conductor rings may be added to the pick assembly to measure additional dynamic conditions during the degradation process. In some embodiments, the conductors may comprise other geometries in addition to rings; these other geometries may not need be concentric. These shapes may include squares, rectangles, triangles, ovals, or any combination thereof.

Figure 7:
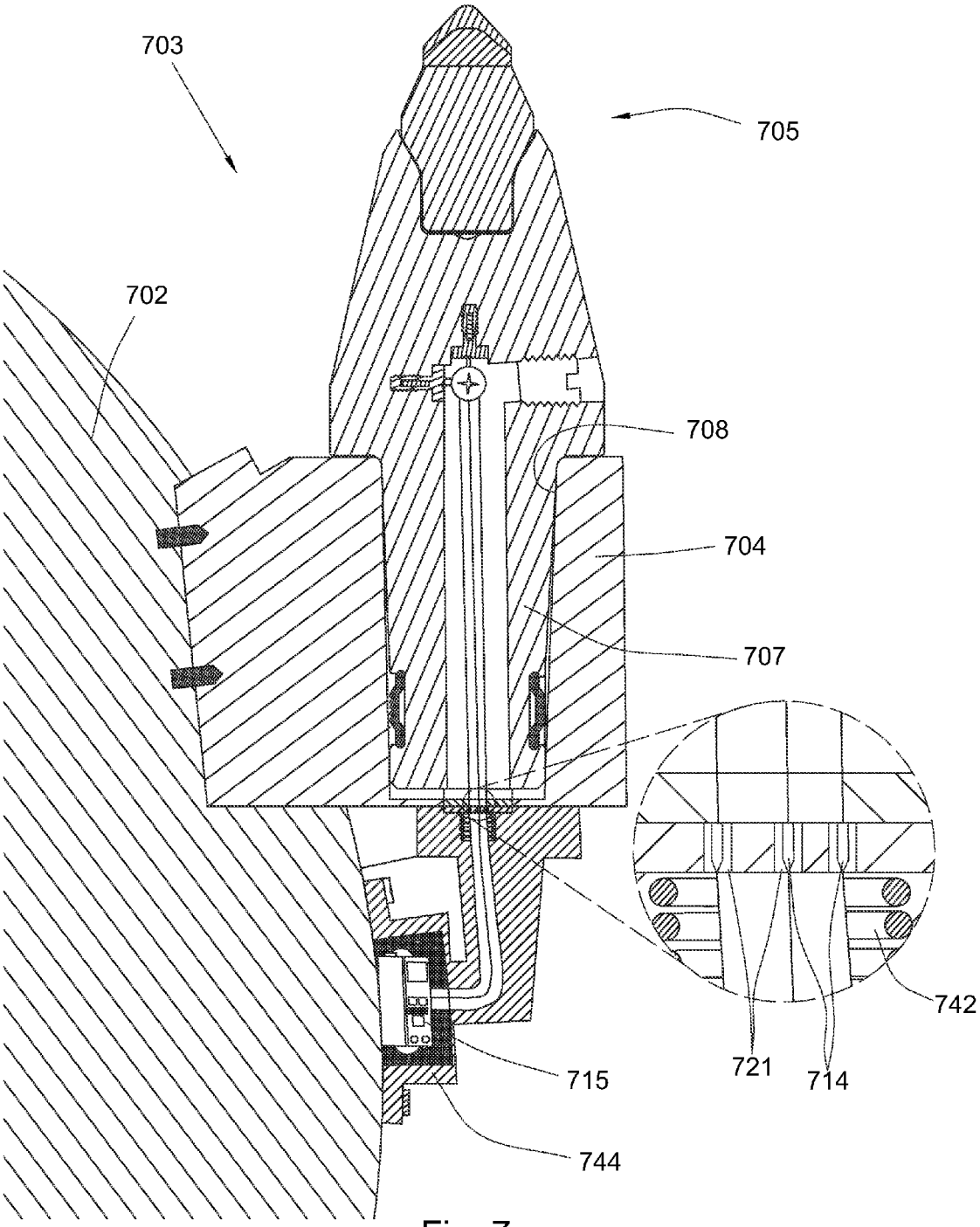
FIG. 7 discloses a cross-sectional view of another embodiment of a degradation assembly.

FIG. 7 discloses an embodiment of a degradation assembly 703. The degradation assembly 703 may comprise a pick 705 disposed in a bore 708 of a receiving element 704. The pick 705 may comprise a pick shank 707 with a plurality of protrusions 714 mating with a plurality of receptacles 721 disposed in the receiving element 704. A helical spring 742 may be disposed against the receptacles 721 to create a force that acts against the receptacles 721 to keep them in constant contact with the protrusions 714. In other embodiments, other types of springs may be utilized.

In addition, a data logging device 715 may be disposed in a housing structure 744 that is attached to a rotary degradation drum 702. The housing structure 744 may disconnect from the drum 702 to allow data removal from the data logging device 715. The housing structure 744 may also be removed to replace the logging device 715 with a new one.

Whereas the present invention has been described in particular relation to the drawings attached hereto, it should be understood that other and further modifications apart from those shown or suggested herein, may be made within the scope and spirit of the present invention.

What is claimed is:

1. A drilling apparatus, comprising:

at least one sensor mounted on a cutting assembly, wherein the cutting assembly is at least partially formed of a diamond material;

the cutting assembly comprising a first conductor in communication with the sensor; and at least one receiving element including a bore comprising a second conductor;

wherein the first and second conductors form a stab connection as the cutting assembly is inserted into the bore of the receiving element.

2. The apparatus of claim 1, wherein the first and second conductors comprise surfaces that directly contact to form the stab connection.

3. The apparatus of claim 1, wherein the stab connection is releasable.

4. The apparatus of claim 1, wherein the bore of the receiving element comprises an inside surface that is complementary to an outside surface of the cutting assembly.

5. The apparatus of claim 4, wherein the complementary inside surface and outside surface are tapered.

6. The apparatus of claim 1, wherein the receiving element is selected from the group consisting of blocks, sleeves, holders, and spring clips.

7. The apparatus of claim 1, wherein an insulation material surrounds the first conductor and second conductor.

8. The apparatus of claim 1, wherein the at least one sensor is selected from the group consisting of strain gauges, accelerometers, thermocouples, and magnetometers.

9. The apparatus of claim 1, wherein the cutting assembly comprises a shank and the at least one sensor is disposed within the shank.

10. The apparatus of claim 9, wherein the shank comprises an annular recess.

11. A drilling apparatus, comprising:

at least one sensor mounted on a cutting assembly, wherein the cutting assembly is at least partially formed of a diamond material;

the cutting assembly comprising a first conductor in communication with the sensor; and at least one receiving element including a bore comprising a second conductor;

wherein the first and second conductors form a connection as the cutting assembly is inserted into the bore of the receiving element, wherein the at least one sensor is powered by an external power source.

12. The assembly of claim 11, wherein the connection comprises a stab connection.

13. The assembly of claim 11, wherein the connection comprises an inductive coupling.

14. The assembly of claim 11, wherein the connection comprises flat contact surfaces.

15. A drilling apparatus, comprising:

at least one sensor mounted on a cutting assembly, wherein the cutting assembly is at least partially formed of a diamond material;

the cutting assembly comprising a first conductor in communication with the sensor; and at least one receiving element including a bore comprising a second conductor;

wherein the first and second conductors form a connection as the cutting assembly is inserted into the bore of the receiving element, wherein the cutting assembly comprises a shank and the at least one sensor is disposed within the shank, the shank including an annular recess having a clamp ring disposed within the annular recess.

* * * * *